US009576523B2

(12) United States Patent
Kim et al.

(10) Patent No.: US 9,576,523 B2
(45) Date of Patent: Feb. 21, 2017

(54) DISPLAY DEVICE INCLUDING POWER CONTROLLER WITH A PLURALITY OF OUTPUT TERMINALS AND METHOD OF DRIVING THE SAME

(71) Applicant: LG DISPLAY CO., LTD., Seoul (KR)

(72) Inventors: Hye-Rim Kim, Ansan-si (KR); Bum-Sik Kim, Suwon-si (KR); Kyoung-Don Woo, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 165 days.

(21) Appl. No.: 13/971,225

(22) Filed: Aug. 20, 2013

(65) Prior Publication Data

US 2014/0111498 A1 Apr. 24, 2014

(30) Foreign Application Priority Data

Oct. 23, 2012 (KR) ..... 10-2012-0117809

(51) Int. Cl.
*G09G 3/3208* (2016.01)
*G09G 3/3291* (2016.01)
(Continued)

(52) U.S. Cl.
CPC ..... *G09G 3/3208* (2013.01); *G09G 3/3291* (2013.01); *G09G 3/006* (2013.01); *G09G 2330/12* (2013.01)

(58) Field of Classification Search
CPC .... G09G 3/006; G09G 3/3208; G09G 3/3283; G09G 3/3291; G09G 3/3685; G09G 3/3696; G09G 2310/0272; G09G 2310/027; G09G 2330/028; G09G 2330/045;G09G 2330/12; G09G 2330/025; G09G 2330/04
See application file for complete search history.

(56) References Cited

U.S. PATENT DOCUMENTS 5,949,194 A * 9/1999 Kawakami et al. ..... 315/169.4
6,380,688 B1 * 4/2002 Bae ..... G09G 3/3233 315/169.3
(Continued)

FOREIGN PATENT DOCUMENTS

JP H09-305145 A 11/1997
JP 2007-248902 9/2007
(Continued)

OTHER PUBLICATIONS

Office Action issued in Taiwanese Patent Application No. 102122529, mailed Nov. 21, 2014, 16 pages.
(Continued)

*Primary Examiner* — Keith Crawley
(74) *Attorney, Agent, or Firm* — Brinks Gilson & Lione

(57) ABSTRACT

There is provided a display device including: a display panel including a display area consisting of a plurality of pixel areas, and a non-display area surrounding the display area; a plurality of power lines formed on the display area to supply a first voltage to the plurality of pixel areas; a first power link line connected to the plurality of first power lines, and formed on the non-display area; and a plurality of drivers connected to the display panel, and including a plurality of output pads and a plurality of first power pads, the plurality of (first) power pads disposed between the plurality of output pads and respectively connected to the plurality of first power link lines.

21 Claims, 6 Drawing Sheets

(51) Int. Cl.
*G09G 3/00* (2006.01)
*G09G 3/32* (2016.01)

(56) References Cited

U.S. PATENT DOCUMENTS

| | | | | |
|---|---|---|---|---|
| 2006/0087247 | A1* | 4/2006 | Malmberg | 315/169.2 |
| 2008/0143655 | A1 | 6/2008 | Ko | |
| 2009/0027375 | A1* | 1/2009 | Ryu et al. | 345/212 |
| 2009/0109147 | A1* | 4/2009 | Park | G09G 3/20 345/76 |
| 2009/0207106 | A1* | 8/2009 | Mizukoshi et al. | 345/76 |
| 2012/0050249 | A1* | 3/2012 | Jin et al. | 345/212 |
| 2012/0127221 | A1* | 5/2012 | Tamaki et al. | 345/691 |
| 2013/0002639 | A1* | 1/2013 | Park | 345/212 |
| 2013/0002736 | A1* | 1/2013 | Park | 345/691 |
| 2013/0021312 | A1* | 1/2013 | Kishi | 345/211 |
| 2014/0084792 | A1* | 3/2014 | Oh et al. | 315/120 |

FOREIGN PATENT DOCUMENTS

| | | | | |
|---|---|---|---|---|
| JP | 2009-508171 | A | 2/2009 | |
| TW | M401833 | U1 | 4/2011 | |
| WO | WO2011125361 | * | 10/2011 | G09G 3/30 |

OTHER PUBLICATIONS

Office Action issued in Japanese Patent Application No. 2013-187306, mailed Jan. 20, 2015, 3 pages.
Office Action issued in Japanese Patent Application No. 2013-187306, mailed Aug. 5, 2014, 4 pages.

* cited by examiner

DISPLAY DEVICE INCLUDING POWER CONTROLLER WITH A PLURALITY OF OUTPUT TERMINALS AND METHOD OF DRIVING THE SAME

The present application claims priority to Korean Patent Application No. 10-2012-0117809, filed on Oct. 23, 2012, the entirety of which is hereby incorporated by reference herein.

BACKGROUND

Field of the Disclosure

The present disclosure relates to a display device, and more particularly, to a display device including a power controller for controlling a source voltage and a method of driving the display device.

Discussion of the Related Art

An organic light-emitting diode (OLED) which is one of flat panel displays (FPDs), has the characteristics of high brightness and a low operating voltage.

The OLED has a high contrast ratio since it is a self-luminous device, can be implemented as an ultra thin display, can easily reproduce moving pictures due to its response time of several microseconds (μs), has no limitation of a viewing angle, and can stably operate at a low temperature. Also, since the OLED can be driven at a low direct current voltage of 5V to 15V, it is easy to manufacture and design a driving circuit with the OLED.

Furthermore, the OLED can be manufactured through a simple manufacturing process including only deposition and encapsulation.

However, since the OLED is a current mode of emitting light by supplying current to light-emitting diodes, it is necessary to supply various high voltages to individual pixel regions through an integrated power line.

The integrated power line of the OLED will be described with reference to FIGS. 1 and 2, below.

FIG. 1 shows an example of a conventional OLED display device 10.

As shown in FIG. 1, the conventional OLED display device 10 includes a light-emitting diode panel 20 that displays images, and a plurality of gate drivers (not shown) and a plurality of data drivers 30 connected to the light-emitting diode panel 20 to supply gate signals and data signals, respectively, and a timing controller 50 for supplying a plurality of gate control signals to the plurality of gate drivers and for supplying a plurality of data control signals and an image data to the plurality of data drivers 30.

The light-emitting diode panel 20 includes a display area DA consisting of a plurality of pixel regions P, and a non-display area NDA surrounding the display area DA. The display area DA includes a plurality of first power lines 22 for supplying a first voltage to the pixel regions P, and the non-display area NDA includes a first integrated power line 24 connected to the first power lines 22 to transfer the first voltage from an external source to the first power lines 22.

Although not shown in the drawings, the display area DA includes a plurality of second power lines for supplying a second voltage to the pixel regions P, and the non-display area NDA includes a second integrated power line 26 connected to the second power lines to transfer the second voltage from an external source to the second power lines.

The plurality of data drivers 30 include a plurality of driving integrated circuits (DICs) 32, a plurality of flexible printed circuits (FPCs) 34 and a data printed circuit board (PCB) 36. The plurality of DICs 32 and the plurality of FPCs 34 may be formed in the form of a chip on film (COF) in which an integrated circuit is mounted on a film such as a tape carrier package (TCP) to connect the data PCB 36 and the light-emitting diode panel 20.

First power supply lines 40 to which the first voltage from the external source is supplied, are formed on both ends of each FPC 34, and the first power supply lines 40 are connected to the first integrated power line 24.

Also, an auxiliary driver 38 such as a film on glass (FOG) may be connected to the light-emitting diode panel 20, and a second power supply line 42 is formed on the auxiliary driver 38 to be connected to the second integrated power line 26.

The timing controller 50 generates a plurality of gate control signals, a plurality of data control signals and an image data using an image signal and a plurality of timing signals received from an external system such as a television system or a graphic card.

FIG. 2 shows another example of a conventional OLED display device 110.

As shown in FIG. 2, the conventional OLED display device 110 according to the other example includes a light-emitting panel 120 that displays images, and a plurality of gate drivers (not shown) and a plurality of data drivers 130 connected to the light-emitting diode panel 120 to supply gate signals and data signals, respectively, and a timing controller 150 for supplying a plurality of gate control signals to the plurality of gate drivers and for supplying a plurality of data control signals and an image data to the plurality of data drivers 130.

The light-emitting diode panel 120 includes a display area DA consisting of a plurality of pixel regions P, and a non-display area NDA surrounding the display area DA. The display area DA includes a plurality of first power lines 122 and a plurality of second power lines (not shown) for supplying first and second voltages to the pixel regions P, and the non-display area NDA includes a first integrated power line 124 connected to the first power lines 122 to transfer the first voltage from an external source to the first power lines 122, and a second integrated power line 126 connected to the second power lines to transfer the second voltage from an external source to the second power lines.

The plurality of data drivers 130 include a plurality of driving integrated circuits (DICs) 132, a plurality of flexible printed circuits (FPCs) 134 and a data printed circuit board (PCB) 136. The plurality of DICs 132 and the plurality of FPCs 134 may be formed in the form of a chip on film (COF) in which an integrated circuit is mounted on a film such as a tape carrier package (TCP) to connect the data PCB 136 and the light-emitting diode panel 120.

First power supply lines 140 to which the first voltage from the external source is supplied are formed on both ends of a front surface of each FPC 134, and second external power lines 142 to which the second voltage from the external source is supplied are formed on both ends of a rear surface of each FPC 134. The first and second power supply lines 140 and 142 are connected to the first and second integrated power lines 124 and 126, respectively.

The timing controller 150 generates a plurality of gate control signals, a plurality of data control signals and an image data using an image signal and a plurality of timing signals received from an external system such as a television system or a graphic card.

In the conventional OLED display devices 10 and 110, the first and second voltages may be a source voltage VDD and a ground voltage VSS, respectively. When the conventional OLED display devices 10 and 110 are operated for a long time, the first power lines 22 and 122 in the light-emitting diode panel 20 and 120 may be electrically shorted with other lines due to the breakdown of their upper and lower insulating layers or the light-emitting diodes may be electrically shorted. As a result, the first power lines 22 and 122 may be burned due to an excessive amount of current.

In addition, since the first and second voltages may be supplied to all pixel regions P of the light-emitting diode panels 20 and 120 through the first integrated power line 24 and 124 and the second integrated power line 26 and 126, an excessive amount of current comes to flow through the first integrated power line 24 and 124 and the second integrated power line 26 and 126. As a result, the first integrated power line 24 and 124 and the second integrated power line 26 and 126 may be electrically open or burned, or electrically shorted with other lines due to the breakdown of their upper and lower insulating layers. The failure of the first integrated power line 24 and 124 and the second integrated power line 26 and 126 is propagated to the first power lines 22 and 122 and the second power lines.

In particular, in the case of a large size display requiring a larger amount of driving current, such a failure becomes a serious problem.

SUMMARY OF THE INVENTION

Accordingly, the present invention is directed to a display device that substantially obviates one or more of the problems due to limitations and disadvantages of the related art.

An object of the present disclosure is to provide a display device including a power controller, capable of preventing a failure such as an electrical shortage or burning by detecting a source current supplied to at least one power line and controlling a source voltage supplied to the at least one power line according to the detection result, and a method of driving the display device.

Another object of the present disclosure is to provide a display device including a power controller, capable of reducing a fabrication cost and simplifying control steps, and a method of driving the display device.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described herein, there is provided a display device, comprising: a plurality of data drivers supplying a data signal; a display panel comprised of a plurality of pixel regions and a plurality of power lines, the display panel being configured to: receive the data signal, and display an image based on the data signal, wherein the plurality of power lines are configured to supply a source voltage to the plurality of pixel regions; and at least one power controller configured to: supply the source voltage to the plurality of power lines, detect a current flowing through the plurality of power lines, and control the source voltage in order to control the source voltage from being supplied to the plurality of power lines based on the detected current.

In another aspect, there is provided a method of driving a display device, comprising: supplying a source voltage from a plurality of output terminals of at least one power controller to a plurality of pixel regions of a display panel, wherein the source voltage is supplied to the pixel regions via a plurality of power lines; supplying a data signal from a plurality of data drivers to the plurality of pixel regions of the display panel; displaying an image using the source voltage and the data signal; detecting, by the at least one power controller, a current flowing through the plurality of power lines, and selectively blocking out the source voltage to the plurality of power lines by the at least one power controller based on the detected current.

According to another aspect of the present invention, there is provided an OLED display device, comprising: a plurality of data drivers supplying a data signal, an OLED display panel comprised of a plurality of pixel regions and a plurality of power lines, the display panel configured to: receive the data signal, and display an image based on the data signal, wherein the plurality of power lines are configured to supply a source voltage to the plurality of pixel regions; at least one power controller configured to: supply the source voltage to the plurality of power lines via a pre-power line, wherein each pre-power line supplies the source voltage to a plurality of power lines; detect a current flowing through the pre-power lines, and control the source voltage according to the detected current.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE PREFERRED EMBODIMENTS

Reference will now be made in detail to the preferred embodiments, examples of which are illustrated in the accompanying drawings. The present invention as described herein may be embodied in a number of different forms. Not all of the depicted components may be required, however, and some implementations may include additional, different, or fewer components from those expressly described in this disclosure. Variations in the arrangement and type of the components may be made without departing from the spirit or scope of the claims as set forth herein.

Figure 1:
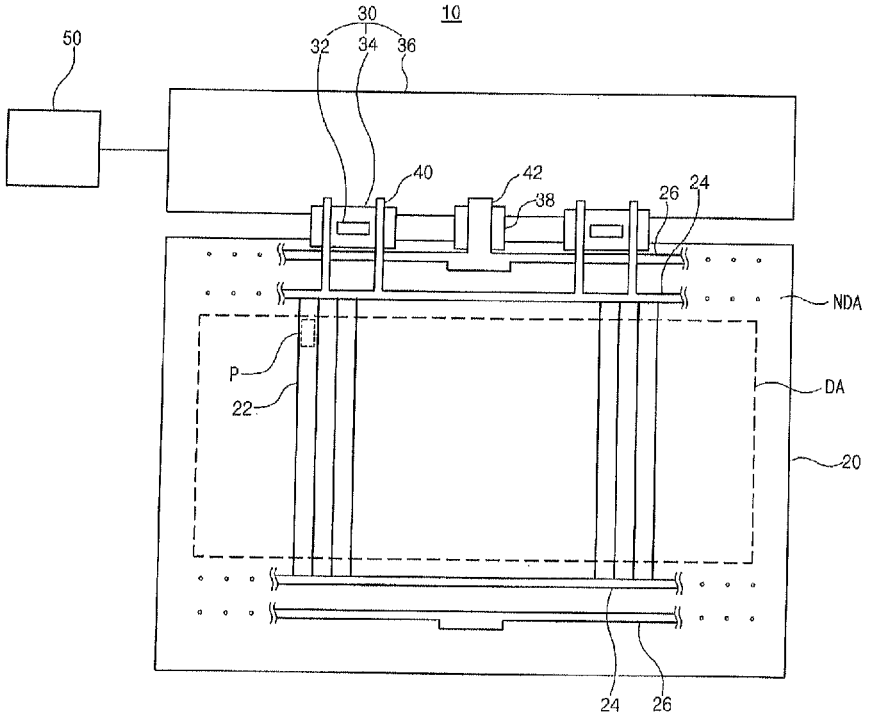
(Prior Art) FIG. 1
FIG. 1 shows an example of a conventional organic light-emitting diode display device.
Figure 2:
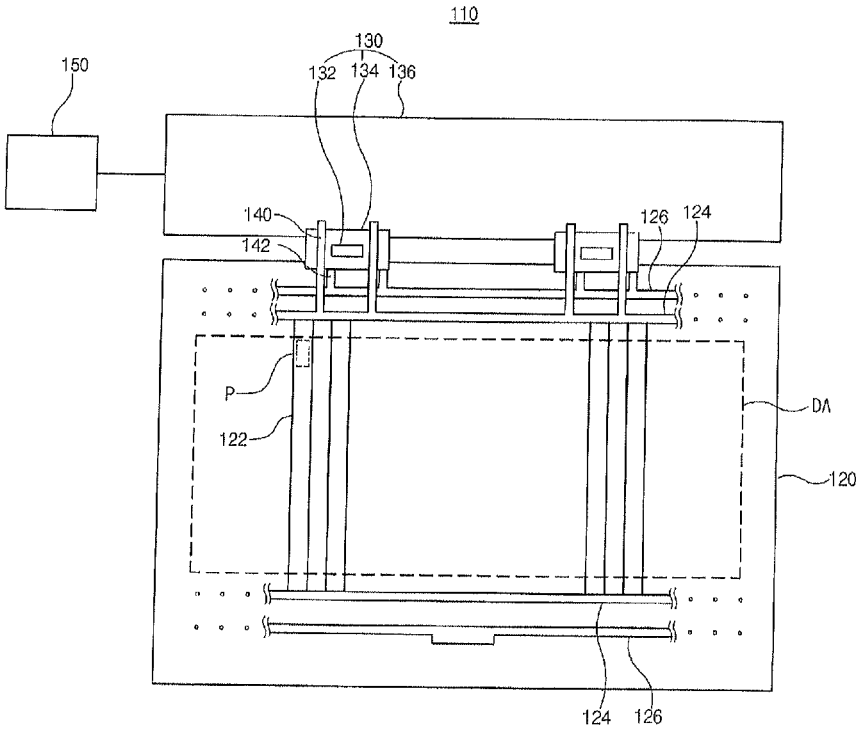
(Prior Art) FIG. 2
FIG. 2 shows another example of a conventional organic light-emitting diode display device.
Figure 3:
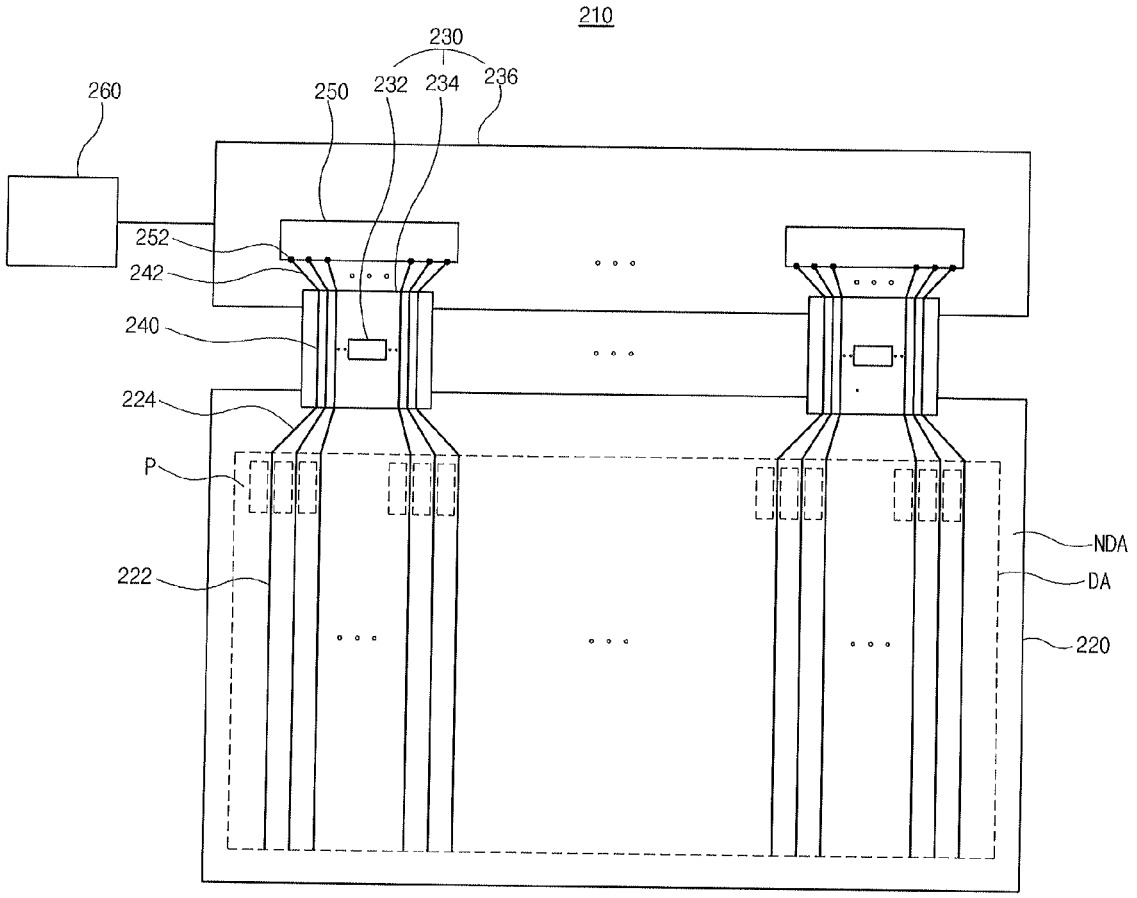
FIG. 3 shows an organic light-emitting diode display device according to a first embodiment of the present invention.

FIG. 3 shows an organic light-emitting diode (OLED) display device 210 according to a first embodiment of the present invention.

As shown in FIG. 3, the OLED display device 210 according to the first embodiment of the present invention includes a light-emitting diode panel 220 that displays images, a plurality of gate drivers (not shown) and a plurality of data drivers 230 connected to the light-emitting diode panel 220 for supplying gate signals and data signals, respectively, a plurality of power controllers 250 connected to the light-emitting diode panel 220 for supplying a source voltage, and a timing controller 260 for supplying a plurality of gate control signals to the plurality of gate drivers and for supplying a plurality of data control signals and an image data to the plurality of data drivers 230.

The light-emitting diode panel 220 includes first and second substrates (not shown) that have a display area DA consisting of a plurality of pixel regions P and a non-display area NDA surrounding the display area DA. In the display area DA of the first substrate, a plurality of power lines 222 for supplying a source voltage VDD to the plurality of pixel regions P are formed in the vertical direction of the light-emitting diode panel 220, and in the non-display area NDA of the first substrate, a plurality of first power link lines 224 connected to the plurality of power lines 222 for transferring the source voltage VDD to the plurality of power lines 222 are formed.

Although not shown in FIG. 3, a plurality of gate lines and a plurality of data lines crossing each other to define the plurality of pixel regions P may be formed in the display area DA of the first substrate. In addition, a switching thin film transistor connected to the gate line and the data line, a driving thin film transistor connected to the switching thin film transistor, a storage capacitor connected to the switching thin film transistor and a light-emitting diode connected to the driving thin film transistor for emitting a light using the source voltage VDD may be formed in the display area DA of the first substrate.

The plurality of data drivers 230 may include a plurality of driving integrated circuits (DICs) 232, a plurality of flexible printed circuits (FPCs) 234 and a data printed circuit board (PCB) 236. The plurality of DICs 232 and the plurality of FPCs 234 may be formed in the form of a chip on film (COF) in which an integrated circuit is mounted on a film such as a tape carrier package (TCP) for connecting the data PCB 236 and the light-emitting diode panel 220.

A plurality of second power link lines 240 respectively connected to the plurality of first power link lines 224 for transferring the source voltage VDD to the plurality of first power link lines 224 are formed on both ends of a front surface of the at least one FPC 234.

The plurality of power controllers 250 may be formed as an integrated circuit mounted on the data PCB 236. While the source voltage VDD is generated and outputted, the plurality of power controllers 250 detect a current flowing through the plurality of power lines 222 of the light-emitting diode panel 220 and control an output of the source voltage VDD.

The at least one power controller 250 includes a plurality of output terminals 252 outputting the source voltage VDD, and a plurality of third power link lines 242 connected to the plurality of output terminals 252 and the plurality of second power link lines 240 for transferring the source voltage VDD of the plurality of power controllers 250 to the plurality of second power link lines 240 are formed on the data PCB 236.

As a result, the source voltage VDD outputted from the plurality of power controllers 250 is transferred to the plurality of power lines 222 through the plurality of first power link lines 224, the plurality of second power link lines 240 and the plurality of third power link lines 242 connected to each other in 1:1:1 correspondence and is supplied to the light-emitting diode in each pixel region P.

Although the plurality of second power link line 240 are formed on both ends of the at least one FPC 234 in the first embodiment of FIG. 3, the plurality of second power link lines 240 may be alternately disposed with a plurality of output terminals (not shown) of the at least one DIC 232 in another embodiment.

The timing controller 250 generates a plurality of gate control signals, a plurality of data control signals and an image data using an image signal and a plurality of timing signals received from an external system such as a television system or a graphic card. For example, the plurality of timing signals may include a data enable (DE) signal, a horizontal synchronization (HSY) signal, a vertical synchronization (VSY) signal and a clock (CLK) signal. The timing controller 250 may output the plurality of gate control signals to the plurality of gate drivers and may output the plurality of data control signals and the image data to the plurality of data drivers 230.

The power controller 250 for controlling supply of the source voltage VDD to the plurality of power lines 222 will be illustrated hereinafter.

Figure 4:
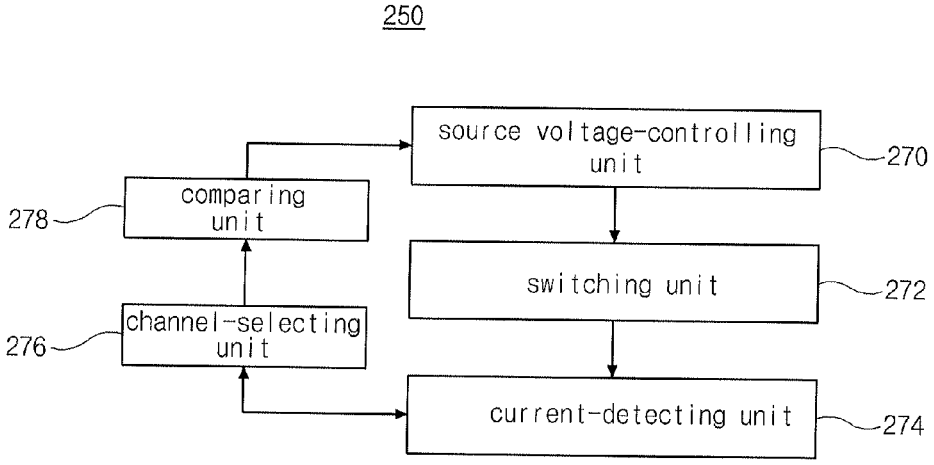
FIG. 4 is a block diagram showing a power controller of an organic light-emitting diode display device according to a first embodiment of the present invention.
Figure 5:
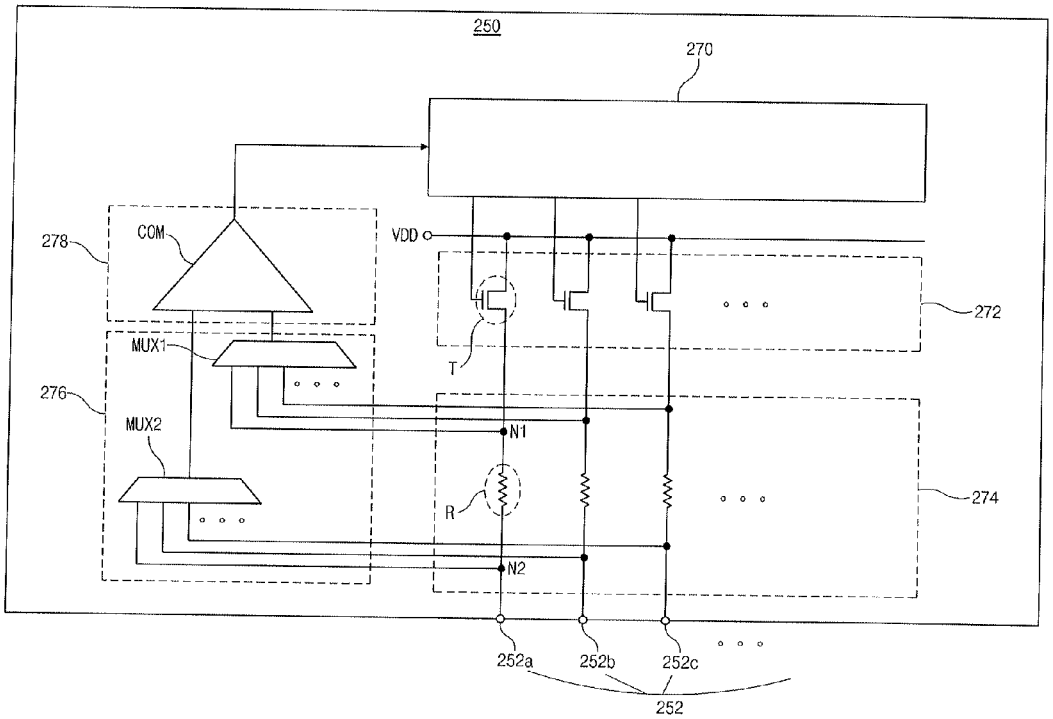
FIG. 5 is a circuit diagram showing a power controller of an organic light-emitting diode display device according to a first embodiment of the present invention.

FIGS. 4 and 5 are a block diagram and a circuit diagram, respectively, showing a power controller 250 of an OLED display device 210 according to a first embodiment of the present invention.

As shown in FIGS. 4 and 5, the at least one power controller 250 of the OLED display device 210 according to the first embodiment of the present invention includes a source voltage-controlling unit 270, a switching unit 272, a current-detecting unit 274, a channel-selecting unit 276 and a comparing unit 278.

The source voltage-controlling unit 270 judges whether the source voltage VDD is outputted or not by controlling the switching unit 272 according to a comparison result of the comparing unit 278.

The switching unit 272 supplies or does not supply the source voltage VDD according to control of the source voltage-controlling unit 270. For example, the switching unit 272 may include a plurality of transistors T connected to a supply line of the source voltage VDD in parallel.

The current-detecting unit 274 detects a current flowing through at least one of the plurality of first power link lines 224, the plurality of second power link lines 240 and the plurality of third power link lines 254. For example, the current-detecting unit 274 may include a plurality of resistors connected between the plurality of transistors T and the plurality of output terminals 252. The plurality of resistors R may include a precision resistor having a resistance of about 0.01 ohm. In addition, a plurality of first nodes N1 are formed between the plurality of transistors T and the plurality of resistors R and a plurality of second nodes N2 are formed between the plurality of resistors R and the plurality of output terminals 252.

The channel-selecting unit 276 selects one from a plurality of supply channels, which are paths of the source voltage VDD outputted from the plurality of output terminals 252 corresponding to the plurality of power lines 222, sequentially or according to a selection signal. For example, the channel-selecting unit 276 may include a first multiplexer MUX1 for selecting one from the plurality of first nodes N1 and a second multiplexer MUX2 for selecting one from the plurality of second nodes N2.

The comparing unit 278 compares the current of the current-detecting unit 274 with a reference current. For example, the comparing unit 278 may include a comparator COM for receiving a first voltage V1 of one of the plurality of first nodes N1 and a second voltage V2 of one of the plurality of second nodes N2, for comparing sizes of the first and second voltages V1 and V2 and for outputting a comparison result.

Operation of the power controller 250 will be illustrated hereinafter.

In a normal state where the plurality of power lines 222 of the light-emitting diode panel 220 (of FIG. 3) do not have deterioration such as an electrical shortage or combustion after the source voltage VDD is outputted from the plurality of output terminals 252, a current equal to or smaller than the reference current flows through the plurality of resistors R. As a result, a voltage drop by the plurality of resistors R is equal to or smaller than a reference voltage drop. The difference (|V1−V2|) between the first and second voltages V1 and V2 is equal to or smaller than a reference voltage corresponding to the reference voltage drop, and the comparator COM outputs a normal state signal corresponding to a voltage difference equal to or smaller than the reference voltage as the comparison result to the source voltage-controlling unit 270. The source voltage-controlling unit 270 controls all the plurality of transistors T to be turned on according to the normal state signal. Accordingly, in the normal state, the source voltage VDD is consistently supplied to the plurality of power lines 222 of the light-emitting diode panel 220.

In an abnormal state where the plurality of power lines 222 of the light-emitting diode panel 220 have deterioration such as an electrical shortage or combustion after the source voltage VDD is outputted from the plurality of output terminals 252, a current greater than the reference current flows through the plurality of resistors R. As a result, a voltage drop by the plurality of resistors R is greater than the reference voltage drop. The difference (|V1−V2|) between the first and second voltages V1 and V2 is greater than the reference voltage corresponding to the reference voltage drop, and the comparator COM outputs an abnormal state signal corresponding to a voltage difference greater than the reference voltage as the comparison result to the source voltage-controlling unit 270.

Since an excessive current flowing through one of the plurality of resistors R corresponding to the plurality of supply channels is detected by the first and second multiplexers MUX1 and MUX2, the comparator COM may discriminate the supply channel of the abnormal state from the plurality of supply channels and may transfer the abnormal state signal including information about the supply channel of the abnormal state to the source voltage-controlling unit 270.

The source voltage-controlling unit 270 controls the transistor T corresponding to the supply channel of the abnormal state among the plurality of transistors T to be selectively turned off according to the abnormal state signal. Accordingly, in the abnormal state, the source voltage VDD is not supplied to the power line 222, where the excessive current flows, of the light-emitting diode panel 220 and is consistently supplied to the power lines 222, where a normal current flows, of the light-emitting diode panel 220.

For example, when the first output terminal 252*a*, the second output terminal 252*b*, the third output terminal 252*c*, the fourth output terminal (not shown) and the fifth output terminal (not shown) output currents of about 10 mA, about 25 mA, about 15 mA, about 15 mA and about 35 mA, respectively, an average current of about 20 mA is within a normal range smaller than a reference current of about 22 mA. However, since each current of the second output terminal 252*b* and the fifth output terminal is an excessive current greater than the reference current, the corresponding power line 222 may be assumed to have deterioration such as an electrical shortage or combustion.

In this case, the source voltage-controlling unit 270 turns off the second transistor T and the fifth transistors T so that the source voltage VDD from the second output terminal 252*b* and the fifth output transistor can be blocked out and turns on the first transistor T, the third transistor T and the fourth transistor T so that the source voltage VDD from the first output terminal 252*a*, the third output terminal 252*c* and the fourth output terminal can be consistently supplied.

A method of driving the OLED display device 210 including the power controller 250 will be illustrated hereinafter.

Figure 6:
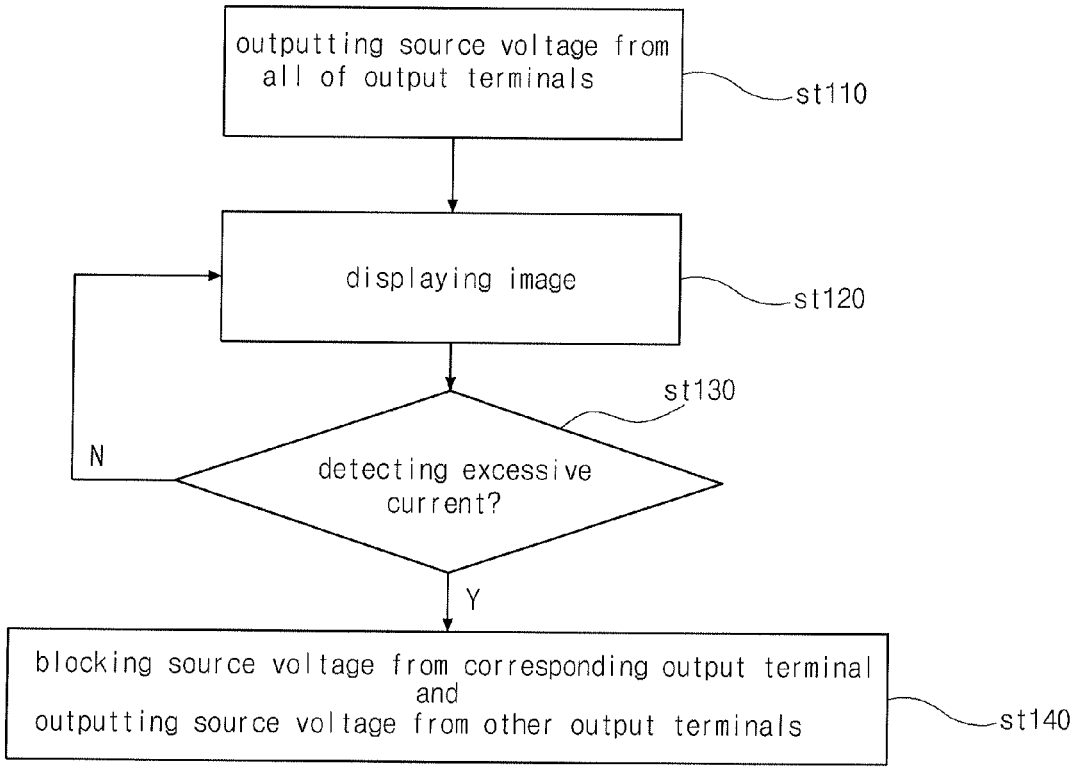
FIG. 6 is a flow chart showing a method of driving an organic light-emitting diode display device according to a first embodiment of the present invention.

FIG. 6 is a flow chart showing a method of driving an OLED display device 210 according to a first embodiment of the present invention, and the method will be illustrated in accompanying FIGS. 3 to 6.

At step st110, the at least one power controller 250 outputs the source voltage VDD from all the plurality of output terminals 252 and the source voltage VDD is supplied to the plurality of power lines 222 of the light-emitting diode panel 220.

At step st120, the plurality of pixel regions P of the light-emitting diode panel 220 display an image using the source voltage VDD, the gate signal and the data signal.

At step st130, the at least one power controller 250 detects the currents flowing through the plurality of power lines 222 and judges whether an excessive current is detected or not.

At step 140, when the excessive current is detected from the selected power line 222, the at least one power controller 250 blocks out the source voltage VDD from the corresponding output terminal 252 and outputs the source voltage VDD from the other output terminals 252. As a result, the light-emitting diode panel 220 may partially display an image.

When the excessive current is not detected from the elected power line 222, the at least one power controller 250 consistently outputs the source voltage VDD from all the plurality of output terminals 252 at step st110. As a result, the light-emitting diode panel 220 may consistently display an image.

In the OLED display device according to a first embodiment of the present invention, since deterioration such as an electrical shortage or combustion of the plurality of power lines 222 of the light-emitting diode panel 220 is prevented by using the power controller 250, fabrication cost is reduced. In addition, since the excessive current of the plurality of power lines 222 is individually detected by using the power controller 250, a portion of deterioration is easily detected by displaying an image partially. Moreover, since the source voltage VDD is blocked out to the power line 222 having deterioration and is supplied to the other power lines 222 by the power controller 250 without using the timing controller 260, burden of a driving unit is lightened.

Although each of the plurality of first power link lines 224 is connected to one power line 222 in the first embodiment of FIG. 3, each of the plurality of first power link lines may be connected to at least two power lines in another embodiment.

Figure 7:
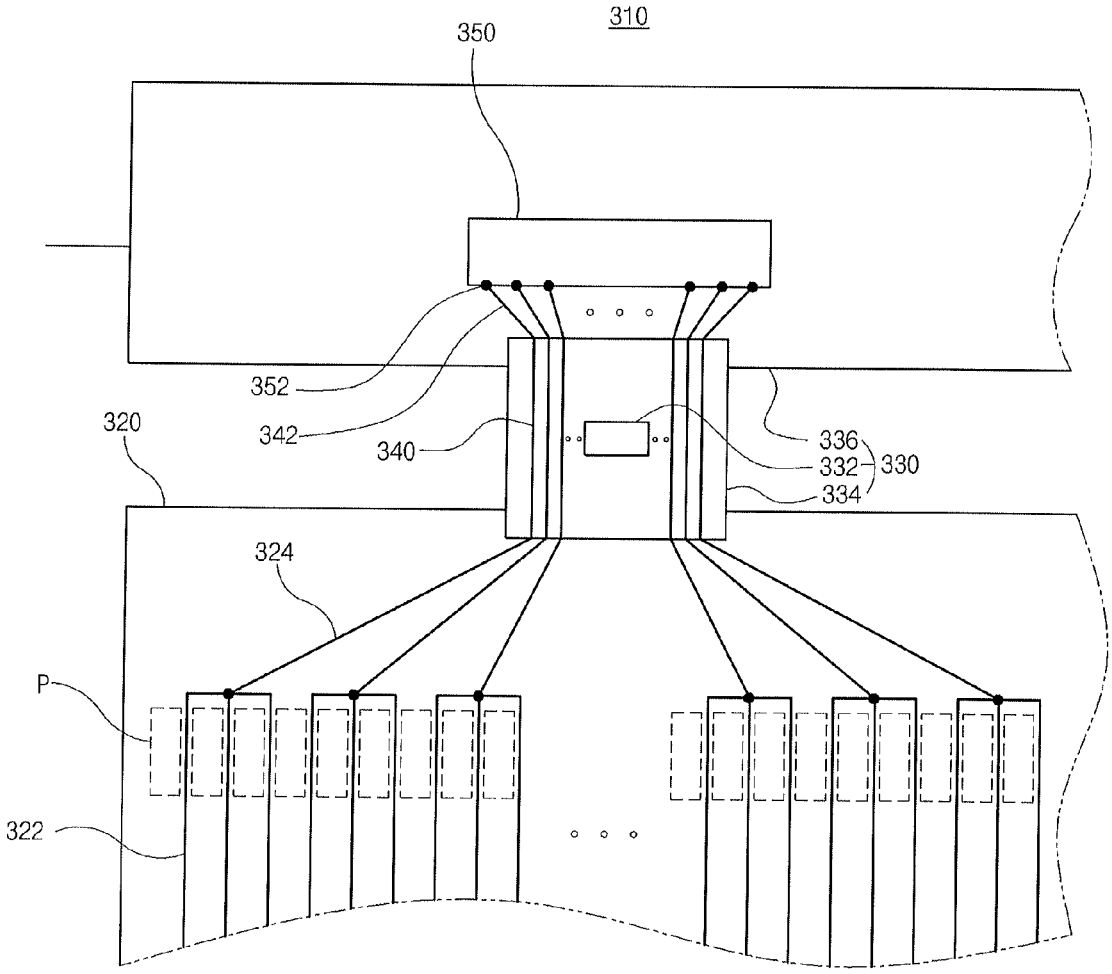
FIG. 7 shows an organic light-emitting diode display device according to a second embodiment of the present invention.

FIG. 7 shows an organic light-emitting diode (OLED) display device 310 according to a second embodiment of the present invention.

As shown in FIG. 7, the OLED display device 310 according to the second embodiment of the present invention includes a light-emitting diode panel 320 that displays images, a plurality of gate drivers (not shown) and a plurality of data drivers 330 connected to the light-emitting diode panel 320 for supplying gate signals and data signals, respectively, a plurality of power controllers 350 connected to the light-emitting diode panel 320 for supplying a source voltage, and a timing controller (not shown) for supplying a plurality of gate control signals to the plurality of gate drivers and for supplying a plurality of data control signals and an image data to the plurality of data drivers 330.

The light-emitting diode panel 320 includes first and second substrates (not shown) that have a display area DA consisting of a plurality of pixel regions P and a non-display area NDA surrounding the display area DA. In the display area DA of the first substrate, a plurality of power lines 322 for supplying a source voltage VDD to the plurality of pixel regions P are formed in the vertical direction of the light-emitting diode panel 320, and in the non-display area NDA of the first substrate, a plurality of first power link lines 324 connected to the plurality of power lines 322 for transferring the source voltage VDD to the plurality of power lines 322 are formed. Each of the plurality of first power link lines 324 may be connected to at least two power lines 322. For example, each of the plurality of first power link lines 324 is connected to three power lines 322.

Although not shown in FIG. 7, a plurality of gate lines and a plurality of data lines crossing each other to define the plurality of pixel regions P may be formed in the display area DA of the first substrate. In addition, a switching thin film transistor connected to the gate line and the data line, a driving thin film transistor connected to the switching thin film transistor, a storage capacitor connected to the switching thin film transistor and a light-emitting diode connected to the driving thin film transistor for emitting a light using the source voltage VDD may be formed in the display area DA of the first substrate.

The plurality of data drivers 330 may include a plurality of driving integrated circuits (DICs) 332, a plurality of flexible printed circuits (FPCs) 334 and a data printed circuit board (PCB) 336. The plurality of DICs 332 and the plurality of FPCs 334 may be formed in the form of a chip on film (COF) in which an integrated circuit is mounted on a film such as a tape carrier package (TCP) for connecting the data PCB 336 and the light-emitting diode panel 320.

A plurality of second power link lines 340 respectively connected to the plurality of first power link lines 324 for transferring the source voltage VDD to the plurality of first power link lines 324 are formed on both ends of a front surface of the at least one FPC 334.

The plurality of power controllers 350 may be formed as an integrated circuit mounted on the data PCB 336. While the source voltage VDD is generated and outputted, the plurality of power controllers 350 detect a current flowing through the plurality of power lines 322 of the light-emitting diode panel 320 and control an output of the source voltage VDD.

The at least one power controller 350 includes a plurality of output terminals 352 outputting the source voltage VDD, and a plurality of third power link lines 342 connected to the plurality of output terminals 352 and the plurality of second power link lines 340 for transferring the source voltage VDD of the plurality of power controllers 350 to the plurality of second power link lines 340 are formed on the data PCB 336.

As a result, the source voltage VDD outputted from the plurality of power controllers 350 is transferred to the plurality of power lines 322 through the plurality of first power link lines 324, the plurality of second power link lines 340 and the plurality of third power link lines 342 connected to each other in 1:1:1 correspondence and is supplied to the light-emitting diode in each pixel region P.

Although the plurality of second power link line 340 are formed on both ends of the at least one FPC 334 in the first embodiment of FIG. 7, the plurality of second power link lines 340 may be alternately disposed with a plurality of output terminals (not shown) of the at least one DIC 332 in another embodiment.

Since at least two power lines 322 are connected to one first power link line 324, the number of the plurality of first power link lines 324, the number of the plurality of second power link lines 340, the number of the third power link lines 342 and the number of the plurality of output terminals 352 of each power controller 350 are reduced. Specifically, since the number of the plurality of second power link lines 340 is reduced, a degree of freedom in design of the plurality of second power link lines 340, which is limited by an area of each FPC 334, is improved. Further, since the number of the plurality of output terminals 352 of each power controller 350 is reduced, cost of each power controller 350, which is formed as an integrated circuit, is reduced.

Although the power controller 250 and 350 is exemplary applied to an OLED display device in the first and second embodiments, the power controller may be applied to a liquid crystal display (LCD) device. In the LCD device including a liquid crystal panel for displaying an image, a gate driver for supplying a gate signal to the liquid crystal panel and a data driver for supplying a data signal to the liquid crystal panel, the power controller for controlling a source voltage supplied to the liquid crystal panel may be formed in the data driver.

Consequently, by detecting a source current supplied to at least one power line and controlling a source voltage supplied to the at least one power line according to the detection result, deterioration such as an electrical shortage or combustion of a display device is prevented.

Also, by a power controller detecting a source current supplied to at least one power line and controlling a source voltage supplied to the at least one power line according to the detection result, a fabrication cost of a display device is reduced and control steps of a method of driving a display device is simplified.

It will be apparent to those skilled in the art that various modifications and variations can be made in a display device of the present disclosure without departing from the sprit or scope of the invention. Thus, it is intended that the present invention covers the modifications and variations of this invention provided they come within the scope of the appended claims and their equivalents.

What is claimed is:

1. A display device, comprising:

a plurality of data drivers supplying a data signal;

a display panel comprised of a plurality of pixel regions and a plurality of power lines, the display panel being configured to:

receive the data signal, and display an image based on the data signal, wherein the plurality of power lines are configured to supply a source voltage to the plurality of pixel regions, and the source voltage is outputted from a plurality of power controllers and is transferred from the plurality of power controllers to the plurality of power lines that supply the plurality of pixel regions; and at least one power controller of the plurality of power controllers configured to:

include a plurality of output terminals;

control output of the source voltage from the plurality of output terminals to supply the source voltage to corresponding power lines from the plurality of power lines, wherein one of the plurality of output terminals connects to only one of the corresponding power lines, detect a current flowing through the plurality of power lines, and control the source voltage in order to control the source voltage from being supplied to the plurality of power lines based on the detected current.

2. The display device of claim 1, wherein the at least one power controller is comprised of:

a source voltage controlling unit configured to control the source voltage, and a current-detecting unit configured to detect the current flowing through the plurality of power lines.

3. The display device of claim 2, wherein the at least one power controller is further comprised of:

a comparing unit configured to compare the current of the current-detecting unit with a reference current, a switching unit configured to be controlled by the source voltage controlling unit to provide the source voltage based on a result of the comparison made by the comparing unit, and a channel-selecting unit configured to select a channel to transmit the source voltage to the comparing unit.

4. The display device of claim 3, wherein the channel-selecting unit is further configured to detect a first voltage from a first node within the current detecting unit and to detect a second voltage from a second node within the current detecting unit, and compare the first voltage with the second voltage, wherein the first node and the second node are along a same power line.

5. The display device of claim 4, wherein a resistor is positioned between the first node and the second node.

6. The display device of claim 1, wherein the at least one power controller controls the source voltage to be consistently provided to the plurality of power lines if the detected current is determined to be in a normal state.

7. The display device of claim 6, wherein the detected current is determined to be in the normal state when the detected current is below a reference current.

8. The display device of claim 1, wherein the at least one power controller controls the source voltage to be cut off from a power line that is determined to be in an abnormal state.

9. The display device of claim 8, wherein the at least one power controller further controls the source voltage to be consistently provided to power lines that are determined to be in a normal state.

10. The display device of claim 1, wherein the power controller is configured to detect the current flowing through the plurality of power lines by selecting a power line from the plurality of power lines, and detecting the current of the selected power line.

11. A method of driving a display device, comprising:

supplying a source voltage from a plurality of output terminals of at least one power controller of a plurality of power controllers to a plurality of pixel regions of a display panel, wherein the source voltage is outputted from the plurality of power controllers and is transferred to a plurality of power lines, and is supplied to the pixel regions via the plurality of power lines, wherein at least one power controller includes a plurality of output terminals and the source voltage is outputted from the plurality of output terminals to a plurality of corresponding power lines from the plurality of power lines, and one of the plurality of output terminals connects to only one of the plurality of corresponding power lines;

supplying a data signal from a plurality of data drivers to the plurality of pixel regions of the display panel;

displaying an image using the source voltage and the data signal;

detecting, by the at least one power controller, a current flowing through the plurality of power lines, and selectively blocking out the source voltage to the plurality of power lines by the at least one power controller based on the detected current.

12. The method of claim 11, wherein selectively blocking out the source voltage comprises the at least one power controller controlling the source voltage to be consistently provided to the plurality of power lines if the detected current is determined to be below a reference current.

13. The method of claim 11, wherein selectively blocking out the source voltage comprises the at least one power controller controlling the source voltage to be cut off from a power line that is determined to have a current that is above a reference current.

14. The method of claim 13, wherein detecting the current flowing through the plurality of power lines comprises selecting a power line from the plurality of power lines, and detecting the current of the selected power line.

15. An OLED display device, comprising:

a plurality of data drivers supplying a data signal, an OLED display panel comprised of a plurality of pixel regions and a plurality of power lines, the display panel configured to:

receive the data signal, and display an image based on the data signal, wherein the plurality of power lines are configured to supply a source voltage to the plurality of pixel regions, and the source voltage is outputted from a plurality of power controllers and is transferred from the plurality of power controllers to the plurality of power lines that supply the plurality of pixel regions;

at least one power controller of the plurality of power controllers configured to:

include a plurality of output terminals;

control output of the source voltage from the plurality of output terminals to supply the source voltage to a plurality of corresponding power lines from the plurality of power lines via a corresponding pre-power line, wherein one of the plurality of output terminals connects to only one pre-power line;

detect a current flowing through the corresponding pre-power line, and control the source voltage according to the detected current, wherein the at least one power controller is comprised of:

a source voltage controlling unit configured to control the source voltage;

a current-detecting unit including a plurality of resistors connected to the source voltage controlling unit, the plurality of resistors connected to the plurality of output terminals, respectively; and a channel selecting unit including a first multiplexer configured to select one from first ends of the plurality of resistors and a second multiplexer configured to select one from second ends of the plurality of resistors.

16. The OLED display device of claim 15, wherein the at least one power controller controls the source voltage to be consistently provided to a pre-power line that is determined to be below a reference current.

17. The OLED display device of claim 15, wherein the at least one power controller controls the source voltage to be cut off from a pre-power line that is determined to be above a reference current.

18. The OLED display device of claim 17, wherein the power controller is configured to detect the current flowing through a plurality of pre-power lines by selecting a pre-power line from the plurality of pre-power lines, and detecting the current of the selected pre-power line.

19. The OLED display device of claim 15, wherein the corresponding pre-power line is comprised of a first pre-power line, a second pre-power line, and a third pre-power line.

20. The OLED display device of claim 19, wherein the first pre-power line connects the plurality of power lines with a flexible printed circuit, the second pre-power line is formed on the flexible printed circuit, and the third pre-power line connects the at least one power controller to the flexible printed circuit.

21. The OLED display device of claim 15, wherein the at least one power controller is further comprised of:

a switching unit including a plurality of transistors connected to the plurality of resistors, respectively; and a comparing unit including a comparator configured to compare a first voltage of the selected one from the first ends and a second voltage of the selected one from the second ends.

* * * * *